US008016575B2

(12) United States Patent
Yeo

(10) Patent No.: US 8,016,575 B2
(45) Date of Patent: Sep. 13, 2011

(54) PUMP FOR DRAWING FLUID

(76) Inventor: Jui Hwa Yeo, Singapore (SG)

( * ) Notice: Subject to any disclaimer, the term of this patent is extended or adjusted under 35 U.S.C. 154(b) by 910 days.

(21) Appl. No.: 11/989,097

(22) PCT Filed: Aug. 1, 2005

(86) PCT No.: PCT/SG2005/000259
§ 371 (c)(1),
(2), (4) Date: Jan. 17, 2008

(87) PCT Pub. No.: WO2007/015680
PCT Pub. Date: Feb. 8, 2007

(65) Prior Publication Data

US 2009/0269229 A1 Oct. 29, 2009

(51) Int. Cl.
*F04B 53/12* (2006.01)

(52) U.S. Cl. ..... 417/547; 417/555.1; 222/209; 222/213; 422/501

(58) Field of Classification Search ..... 417/547, 417/555.1; 422/501, 505; 73/864.01, 864.25; 137/150; 92/117 R, 152; 222/205, 206, 222/209, 212, 213
See application file for complete search history.

(56) References Cited

U.S. PATENT DOCUMENTS

| | | | | |
|---|---|---|---|---|
| 56,596 | A | 7/1866 | Naglee | |
| 2,608,320 | A * | 8/1952 | Harrison, Jr. | 222/95 |
| 2,720,343 | A * | 10/1955 | Ross et al. | 222/209 |
| 2,795,245 | A | 6/1957 | Meehan | |
| 2,994,349 | A * | 8/1961 | Demos | 73/864.15 |
| 3,219,417 | A | 11/1965 | Klingbeil et al. | |
| 3,461,868 | A | 8/1969 | Palich | |
| 4,858,478 | A | 8/1989 | Kush et al. | |
| 5,510,083 | A | 4/1996 | Sack et al. | |
| 6,216,916 | B1 | 4/2001 | Maddox et al. | |
| 6,497,560 | B2 * | 12/2002 | Carlson | 417/553 |

FOREIGN PATENT DOCUMENTS

WO WO98/46174 10/1998

* cited by examiner

*Primary Examiner* — Charles Freay
*Assistant Examiner* — Patrick Hamo
(74) *Attorney, Agent, or Firm* — Weaver Austin Villeneuve & Sampson LLP

(57) ABSTRACT

A fluid drawing device (10) comprising a hand pump (11) connected to a fluid reservoir (12). The reservoir (12) has an inlet/outlet orifice (18) through which fluid can be drawn into and expelled from the reservoir (12). The pump (11) comprises a squeeze bulb (13) with an air release valve (14) in its wall and an air intake valve (15). Compressing the bulb (13) releases the air to the atmosphere through the release valve (14), subsequent decompression of the bulb (13) draws air through the intake valve (15) from the reservoir (12) reducing the pressure in it to draw fluid through the orifice (18) into the reservoir (12). Pushing a plunger (24) slidably housed within the reservoir (12) expels the fluid out through the orifice (18).

15 Claims, 3 Drawing Sheets

PUMP FOR DRAWING FLUID

RELATED-APPLICATION

This application is related to International Application No. PCT/SG2005/000259 filed on Aug. 1, 2005, the priority of which is claimed pursuant to 35 USC 120 and 363. The disclosure of that application is incorporated by reference herein in its entirety.

FIELD OF THE INVENTION

The present invention relates to devices for drawing fluid.

BACKGROUND OF THE INVENTION

There are a wide range of circumstances in which fluid must be transferred from one place to another. For instance, in a scientific laboratory, a pipette is commonly used to transfer a fluid (such as blood) from a beaker to a test tube, or from one test tube to another.

Current devices for drawing fluid generally include a reservoir for storing the fluid, a fluid inlet/outlet orifice through which fluid can be drawn, and a compressible hand pump. In use, the pump is compressed, which forces air out through the inlet/outlet orifice. The orifice is then inserted into the fluid source (from which fluid is to be drawn), and the pump allowed to decompress. This draws air from the reservoir, reducing the pressure in the reservoir and thereby drawing fluid in through the inlet/outlet orifice. To expel fluid from the device, the pump is compressed again. This increases the pressure in the reservoir and forces fluid back out through the inlet/outlet orifice.

Current devices suffer from the disadvantage that the pump cannot be repeatedly compressed and decompressed, to draw more fluid, because each compression will force the drawn fluid out of the inlet/outlet orifice. These devices are not capable of retaining fluid which has been drawn, which makes it difficult to draw an exact volume as required.

It is an object of the present invention to reduce or eliminate some or all of the disadvantages of conventional devices for drawing fluid.

SUMMARY OF THE INVENTION

The present invention accordingly provides a device for drawing fluid comprising:

a reservoir to store the fluid, having an orifice through which fluid can enter or exit the reservoir; and a hand pump connected to the reservoir and arranged, in use, to draw fluid into the reservoir, said hand pump including:

a squeeze bulb in fluid communication with the reservoir; an air release valve in the wall of the bulb to permit release of air from the bulb to atmosphere when the bulb is compressed (e. g. by squeezing), and an air intake valve to allow flow of air into the bulb from the reservoir when the bulb decompresses, thereby reducing the pressure in the reservoir to draw fluid through the orifice into the reservoir, arranged so that when the bulb is compressed the air release valve is open and the air intake valve is closed, while when the bulb decompresses the air release valve is closed and the air intake valve is open to allow air to be drawn into the bulb from the reservoir; and a plunger slidably housed within the reservoir and connected to the wall of the bulb, actuable to expel drawn fluid through the orifice, said plunger including a tubular rod extending between the air intake valve and the reservoir, thereby allowing air flow between the reservoir and the bulb when the air intake valve is open.

Desirably, the air release valve is a one-way valve moveable between an open position to permit the release of air when the bulb is compressed, and a closed position when the bulb is released and decompresses.

Desirably, the air intake valve is a one-way valve which is closed when the bulb is compressed, and is open when the bulb is released and decompresses, thereby allowing air to be drawn into the bulb from the reservoir.

The plunger is preferably actuated whilst simultaneously closing the air release valve. This helps to prevent the intake of air to the bulb from the reservoir, which would hinder the operation of the plunger to expel the fluid. Preferably, therefore, the air release valve is positioned at the top of the device, and actuation of the plunger can occur by applying downward pressure at or adjacent the air release valve, which assists the user to easily expel fluid. For this purpose, the plunger may include a bridging piece connecting the air intake valve and the air release valve, and forming a coaxial extension of the tubular rod. Once the fluid is expelled, the device can then be reused by returning the plunger to its original position. The plunger can be spring loaded if required.

The reservoir may take any form, provided it can receive and store fluid. It may include a capillary tube terminating in the orifice, to assist in drawing in fluid, and a larger cylindrical tube which can accommodate the slidable plunger. Preferably, the plunger will sealingly engage the inner surfaces of the larger cylindrical tube. The reservoir will typically be formed from plastic or glass, but there may be other suitable substances.

BRIEF DESCRIPTION OF THE DRAWINGS

An illustrative embodiment of the present invention will be discussed with reference to the accompanying drawings wherein.

DESCRIPTION OF PREFERRED EMBODIMENT

Figure 1:
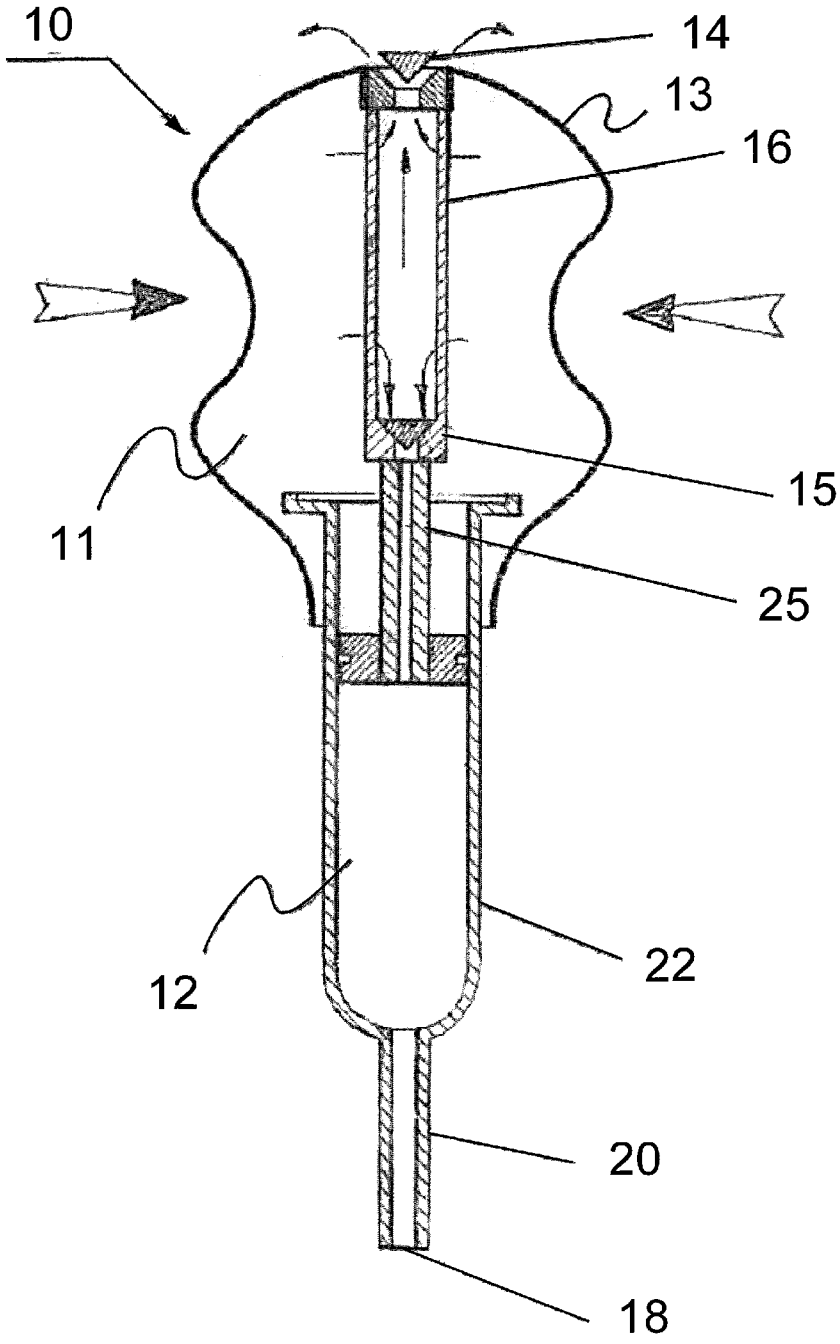
FIG. 1 is a view of a fluid drawing device according to a preferred embodiment of the present invention, with the pump compressed.

FIG. 1 shows a fluid drawing device 10 comprising a hand pump 11 connected to a fluid reservoir 12. The hand pump 11 comprises a squeeze bulb 13, with an air release valve 14 in the wall of the squeeze bulb 13, and an air intake valve 15. The air release valve 14 and air intake valve 15 are rigidly connected by bridging piece 16, which does not interfere with air flow between the valves 14, 15 and the bulb 13.

The fluid reservoir 12 has an inlet/outlet orifice 18 through which fluid can be drawn into and expelled from the reservoir 12. The reservoir 12 further comprises a capillary tube 20 extending from the orifice 18 and a larger cylindrical tube 22. The tubes 20, 22 will typically be formed from glass or plastic.

A plunger 24 is slidably fitted and sealingly engages within the cylindrical tube 22. The plunger 24 is connected to the hand pump 11 through the bridging piece 16, at the air intake valve 15. The plunger 24 includes a central tubular rod 25 connected to the plunger head, the tubular rod 25 allowing the pump 11 and the reservoir to remain in fluid connection with each other, when the air intake valve 15 is open.

Figure 2:
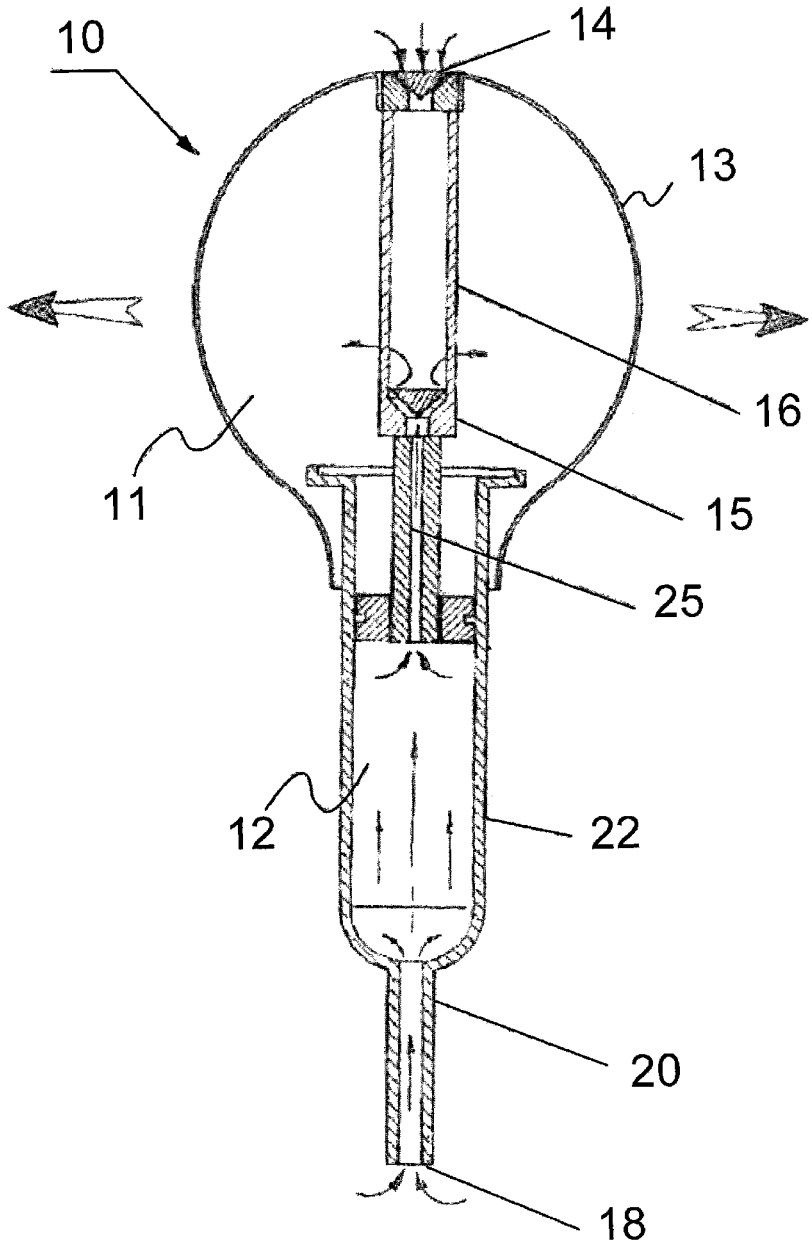
FIG. 2 is a view of the fluid drawing device of FIG. 1, wherein the pump is allowed to decompress.
Figure 3:
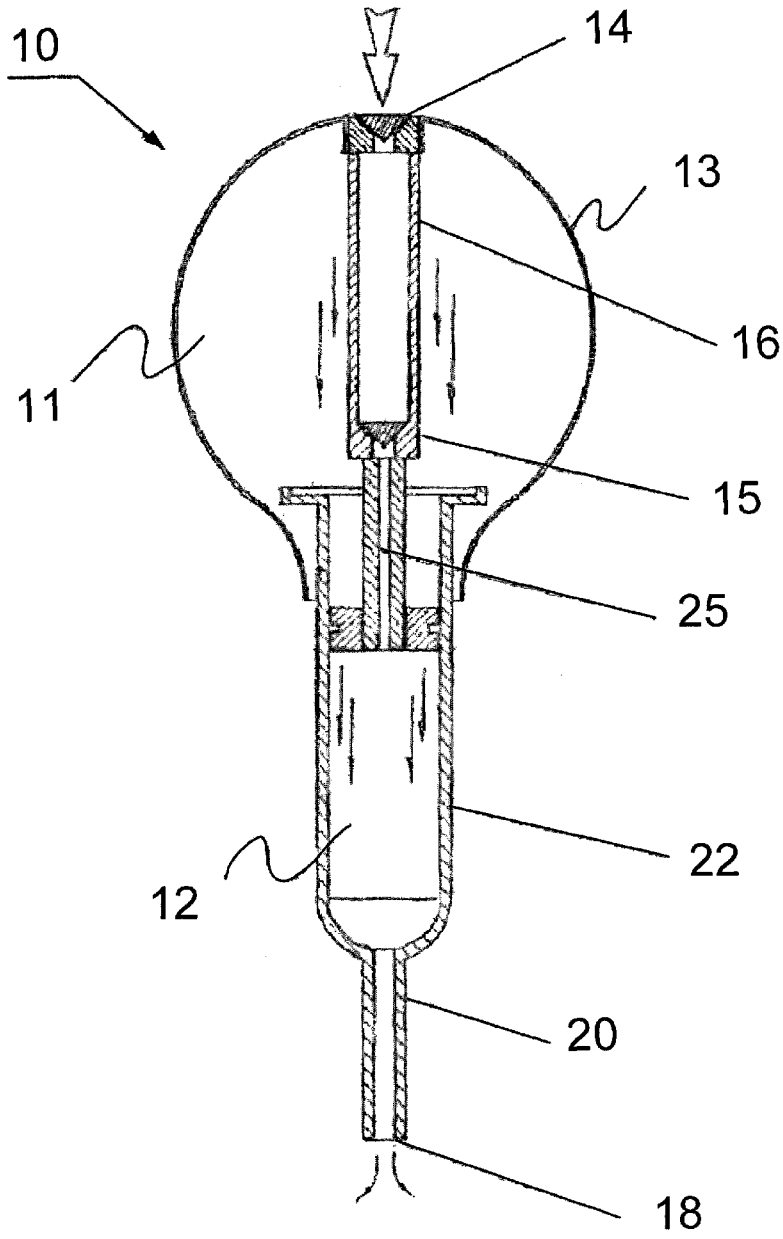
FIG. 3 is a view of the fluid drawing device of FIG. 1, wherein fluid is being expelled.

Operation of the fluid drawing device 10 is shown sequentially through FIGS. 1 to 3. When the bulb 13 is compressed, as shown in FIG. 1, the air release valve 14 opens and air is therefore forced out through the air release valve 14 to atmosphere. However, the air intake valve 15 remains closed, thereby preventing the release of air into the fluid reservoir 12.

The orifice 18 is then inserted into the fluid source, from which fluid is to be drawn, and the bulb 12 is allowed to decompress, as shown in FIG. 2. As will be understood, the orifice 18 can of course be inserted into the fluid source at an earlier time. In any case, upon decompression of the bulb 13, the air release valve 14 closes thereby preventing air intake from the atmosphere. However, the air intake valve 15 opens allowing air flow into the bulb 13 from the reservoir 12. This reduces the air pressure in the reservoir, and accordingly fluid is drawn in through the orifice 18, up through the capillary tube 20 and into the larger cylindrical tube 22.

This procedure can be repeated as required, in order to allow the required volume of fluid to be stored in the reservoir. If the bulb 13 is squeezed again, the air intake valve 15 remains closed. This prevents air from being forced into the reservoir 12, which would force out the drawn fluid. Instead, the air release valve 14 is open, which allows air to be released to the atmosphere.

The larger cylindrical tube 22 serves as an overflow compartment, thereby helping to prevent the fluid from flowing into the squeeze bulb 13. It also serves to prevent the flooding of the air intake valve 15.

Once the required volume of fluid has been stored, it can be expelled by actuation of the plunger 24, as shown in FIG. 3. The bridging piece 16 forms a coaxial extension of the tubular rod. Accordingly, by holding down the air release valve 14 (e. g. with the thumb) and pushing down on bridging piece 16, the plunger 24 is slidably actuated to expel the drawn fluid. Air intake through the air intake valve 15 is minimal, since the air release valve 14 is closed. The bulb 13 may also be compressed during actuation of the plunger 24.

Although a preferred embodiment of the present invention has been described in the foregoing detailed description, it will be understood that the invention is not limited to the embodiment disclosed, but is capable of numerous rearrangements, modifications and substitutions without departing from the scope of the invention. Modifications and variations such as would be apparent to a skilled addressee are deemed within the scope of the present invention.

The claims defining the invention are as follows:

1. A device for drawing fluid comprising:

a reservoir to store the fluid, having an orifice through which fluid can enter or exit the reservoir; and a hand pump connected to the reservoir and arranged, in use, to draw fluid into the reservoir, said hand pump including:

a squeeze bulb in fluid communication with the reservoir;

an air release valve in the wall of the bulb to permit release of air from the bulb to atmosphere when the bulb is compressed; and an air intake valve to allow flow of air into the bulb from the reservoir when the bulb decompresses, thereby reducing the pressure in the reservoir to draw fluid through the orifice into the reservoir, arranged so that when the bulb is compressed the air release valve is open and the air intake valve is closed, while when the bulb decompresses the air release valve is closed and the air intake valve is open to allow air to be drawn into the bulb from the reservoir; and a plunger slidably housed within the reservoir and connected to the wall of the bulb, actuable to expel drawn fluid through the orifice, said plunger including a tubular rod extending between the air intake valve and the reservoir, thereby allowing air flow between the reservoir and the bulb when the air intake valve is open.

2. A device as in claim 1,wherein the air release valve is a one-way valve moveable between an open position to permit the release of air when the bulb is compressed, and a closed position when the bulb is released and decompresses.

3. A device as in claim 1, wherein the air intake valve is a one-way valve moveable between a closed position when the bulb is compressed, and an open position when the bulb is released and decompresses.

4. A device as in claim 1, wherein the plunger further includes a bridging piece connecting the air intake valve and the air release valve, the bridging piece forming a coaxial extension of the tubular rod whereby actuation of the plunger can occur by applying downward force at or adjacent the air release valve.

5. A device as in claim 3, wherein the plunger is sealingly engaged within the reservoir.

6. A device as in claim 1, wherein the reservoir includes a large diameter tube which joins to a coaxial capillary tube which terminates at its distal end in the orifice.

7. A device as in claim 2, wherein the air intake valve is a one-way valve moveable between a closed position when the bulb is compressed, and an open position when the bulb is released and decompresses.

8. A device as in claim 2, wherein the plunger further includes a bridging piece connecting the air intake valve and the air release valve, the bridging piece forming a coaxial extension of the tubular rod whereby actuation of the plunger can occur by applying downward force at or adjacent the air release valve.

9. A device as in claim 3, wherein the plunger further includes a bridging piece connecting the air intake valve and the air release valve, the bridging piece forming a coaxial extension of the tubular rod whereby actuation of the plunger can occur by applying downward force at or adjacent the air release valve.

10. A device as in claim 1, wherein the plunger is sealingly engaged within the reservoir.

11. A device as in claim 2, wherein the plunger is sealingly engaged within the reservoir.

12. A device as in claim 4, wherein the plunger is sealingly engaged within the reservoir.

13. A device as in claim 3, wherein the reservoir includes a large diameter tube which joins to a coaxial capillary tube which terminates at its distal end in the orifice.

14. A device as in claim 4, wherein the reservoir includes a large diameter tube which joins to a coaxial capillary tube which terminates at its distal end in the orifice.

15. A device as in claim 5, wherein the reservoir includes a large diameter tube which joins to a coaxial capillary tube which terminates at its distal end in the orifice.

* * * * *